US011228133B2

(12) United States Patent
Huang

(10) Patent No.: US 11,228,133 B2
(45) Date of Patent: Jan. 18, 2022

(54) HIGH SPEED CONNECTOR FOR REDUCING CROSSTALK EFFECT

(71) Applicant: Industrial Technology Research Institute, Hsinchu (TW)

(72) Inventor: Tien-Fu Huang, Hsinchu County (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 0 days.

(21) Appl. No.: 16/907,978

(22) Filed: Jun. 22, 2020

(65) Prior Publication Data

US 2021/0320449 A1 Oct. 14, 2021

(30) Foreign Application Priority Data

Apr. 9, 2020 (TW) ..... 109111914

(51) Int. Cl.
*H01R 13/506* (2006.01)
*H01R 13/6581* (2011.01)
*H01R 13/6461* (2011.01)

(52) U.S. Cl.
CPC ..... *H01R 13/506* (2013.01); *H01R 13/6461* (2013.01); *H01R 13/6581* (2013.01)

(58) Field of Classification Search
CPC ..... H01R 13/506; H01R 13/6461; H01R 13/6464; H01R 13/6581; H01R 12/724
See application file for complete search history.

(56) References Cited

U.S. PATENT DOCUMENTS 6,517,382 B2 2/2003 Flickinger et al.
6,524,134 B2 2/2003 Flickinger et al.
6,749,448 B2 6/2004 Bright et al.
6,816,376 B2 11/2004 Bright et al.
7,070,446 B2 7/2006 Henry et al.
7,074,082 B2 7/2006 Kerlin et al.
7,303,438 B2 12/2007 Dawiedczyk et al.
(Continued)

FOREIGN PATENT DOCUMENTS

CN 204947242 U 1/2016
CN 107645105 A 1/2018
(Continued)

OTHER PUBLICATIONS

TW OA issued on Jan. 28, 2021.

*Primary Examiner* — Oscar C Jimenez
(74) *Attorney, Agent, or Firm* — WPAT, PC

(57) ABSTRACT

A high speed connector includes an insulated shelter for accommodating at least one main body. The main body includes at least one terminal group integrated with the main body by having two opposing sides thereof to extend out of the main body, in which the two opposing sides are defined as a contact portion and a welding portion, respectively. The terminal group further includes a plurality of terminals. The insulated plastic element has a slot for enclosing up terminal group, and a height of a section in the slot is larger than a thickness of the plurality of terminals, so that at least one gap can be formed in the slot. By having the gap, dielectric coefficients and electromagnetic properties around the terminals can be adjusted to reduce the crosstalk effects upon the signal terminals. In addition, an insulated plastic element is also provided.

14 Claims, 6 Drawing Sheets

(56) References Cited

U.S. PATENT DOCUMENTS

| | | | | |
|---|---|---|---|---|
| 7,448,897 | B2 | 11/2008 | Dawiedczyk et al. | |
| RE43,427 | E | 5/2012 | Dawiedczyk et al. | |
| 8,167,631 | B2 | 5/2012 | Ito et al. | |
| 8,292,669 | B2 | 10/2012 | Wang et al. | |
| 8,353,707 | B2 | 1/2013 | Wang et al. | |
| 8,808,029 | B2 | 8/2014 | Castillo et al. | |
| 9,385,479 | B1 * | 7/2016 | Schmitt | H01R 13/6471 |
| 10,185,100 | B2 | 1/2019 | Takano et al. | |
| 10,403,565 | B1 * | 9/2019 | Henry | H01L 23/49517 |
| 10,665,963 | B2 * | 5/2020 | Huang | H01R 4/02 |
| 2015/0280375 | A1 * | 10/2015 | Xu | H01R 13/6594 439/607.01 |
| 2016/0211629 | A1 * | 7/2016 | Phillips | H01R 13/6471 |
| 2020/0266584 | A1 * | 8/2020 | Lu | H01R 12/79 |

FOREIGN PATENT DOCUMENTS

| | | |
|---|---|---|
| TW | I501483 | 9/2015 |
| TW | M516245 | 1/2016 |
| TW | I556525 | 11/2016 |

* cited by examiner

HIGH SPEED CONNECTOR FOR REDUCING CROSSTALK EFFECT

CROSS REFERENCE TO RELATED APPLICATION

This application claims the benefits of Taiwan application Serial No.

109111914, filed on Apr. 9, 2020, the disclosures of which are incorporated by references herein in its entirety.

TECHNICAL FIELD

The present disclosure relates in general to an electronic connector capable of reducing crosstalk effects.

BACKGROUND

Signal transmission inside an electronic device is generally fulfilled via various electronic connectors. Generally speaking, the electronic connector or the connector is consisted of an insulated main body and a plurality of metal terminals. With development of technology, the amount of information needed to be transmitted is increasing, and thus a corresponding change in transmission frequency or rate shall be evaluated. However, in transmitting high-speed signals, effects of crosstalk among metal terminals would become significant. In particular, if the arrangement of the metal terminals is too dense or lack of shielding, corresponding transmission quality would be closely correlated.

Currently, some efforts have been made to improve problems caused by crosstalk effects. These efforts include changing appearance of metal terminals, increasing spacing between metal terminals, isolating metal terminals by shielding elements and so on. However, such an effort is hard to satisfy a modern requirement in miniaturizing the connector.

Thus, in improved connector that can reduce crosstalk effects and resolve accompanying problems is definitely urgent in the art.

SUMMARY

An object of the present disclosure is to provide a connector that utilizes an insulated plastic element to improve crosstalk effects in transmitting high-speed signals so as to assure quality in signal transmission.

In one embodiment of this disclosure, a high speed connector includes an insulated shelter for accommodating at least one main body. The main body includes at least one terminal group integrated with the main body by having two opposing sides thereof to extend out of the main body, in which the two opposing sides are defined as a contact portion and a welding portion, respectively. The terminal group further includes a plurality of terminals. The insulated plastic element has a slot for enclosing up terminal group, and a height of a section in the slot is larger than a thickness of the plurality of terminals, so that at least one gap can be formed in the slot.

In another embodiment of this disclosure, an insulated plastic element is applied to a connector. The connector includes an insulated shelter, at least one main body. The main body includes at least one terminal group integrated with the main body by having two opposing sides thereof to extend out of the main body. The terminal group further includes a plurality of terminals. The insulated plastic element has a slot for enclosing up terminal group, and a height of a section in the slot is larger than a thickness of the plurality of terminals, so that at least one gap can be formed in the slot.

As stated above, by providing at least one air gap forming another medium to space the terminals for transmitting high-speed signals from the insulated plastic element, the dielectric coefficients and the electromagnetic properties around the terminals can be adjusted to reduce the crosstalk effects upon the signal terminals, and thus the transmission performance of the connector can be substantially improved.

Further, the resort of this disclosure does not involve change in the terminal appearance and interval, thus the structuring of the connector can be kept the same. In other words, the insulated plastic element of this disclosure can be applied to versatile specs of the connectors for reducing the notorious inherent crosstalk effects.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
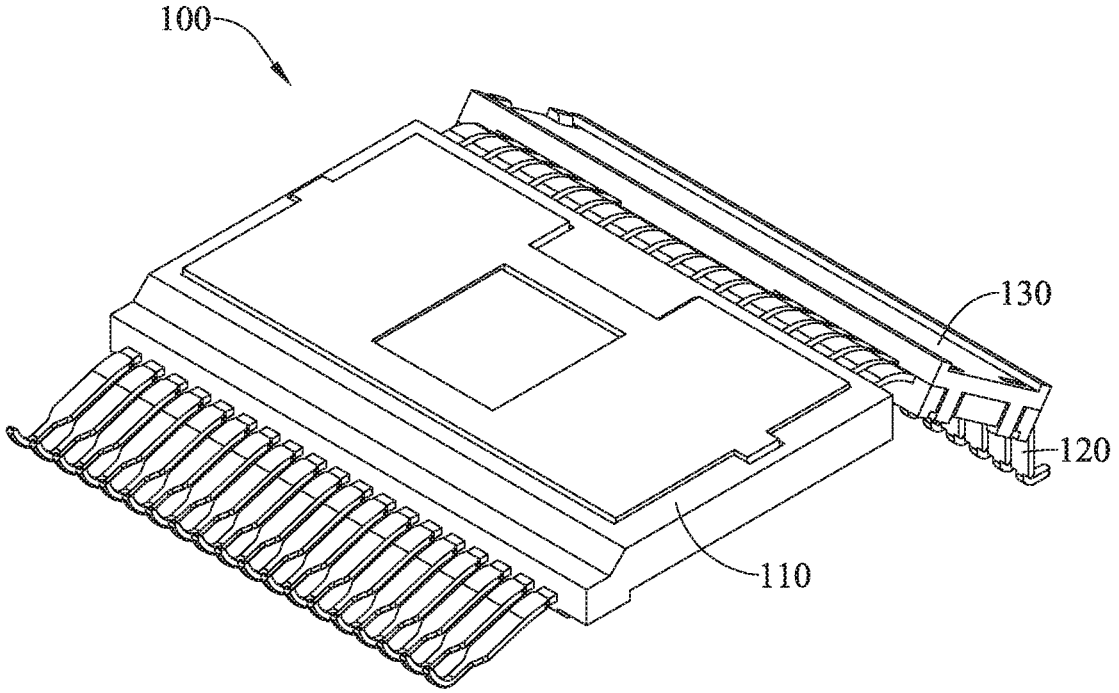
FIG. 1 is a schematic perspective view of an embodiment of the connector in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
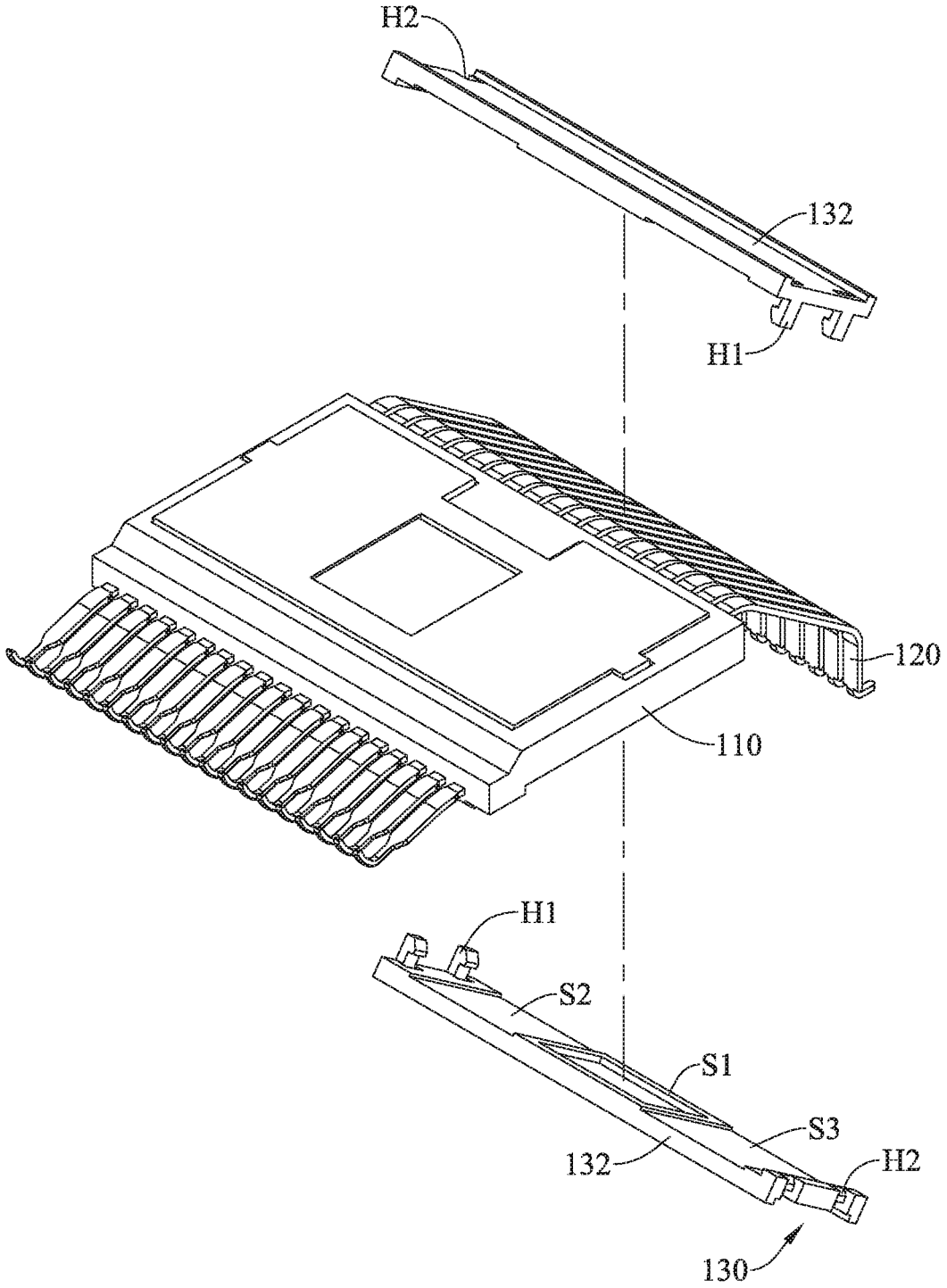
FIG. 2 is another view of FIG. 1 with the spacer plate separated therefrom.
Figure 3:
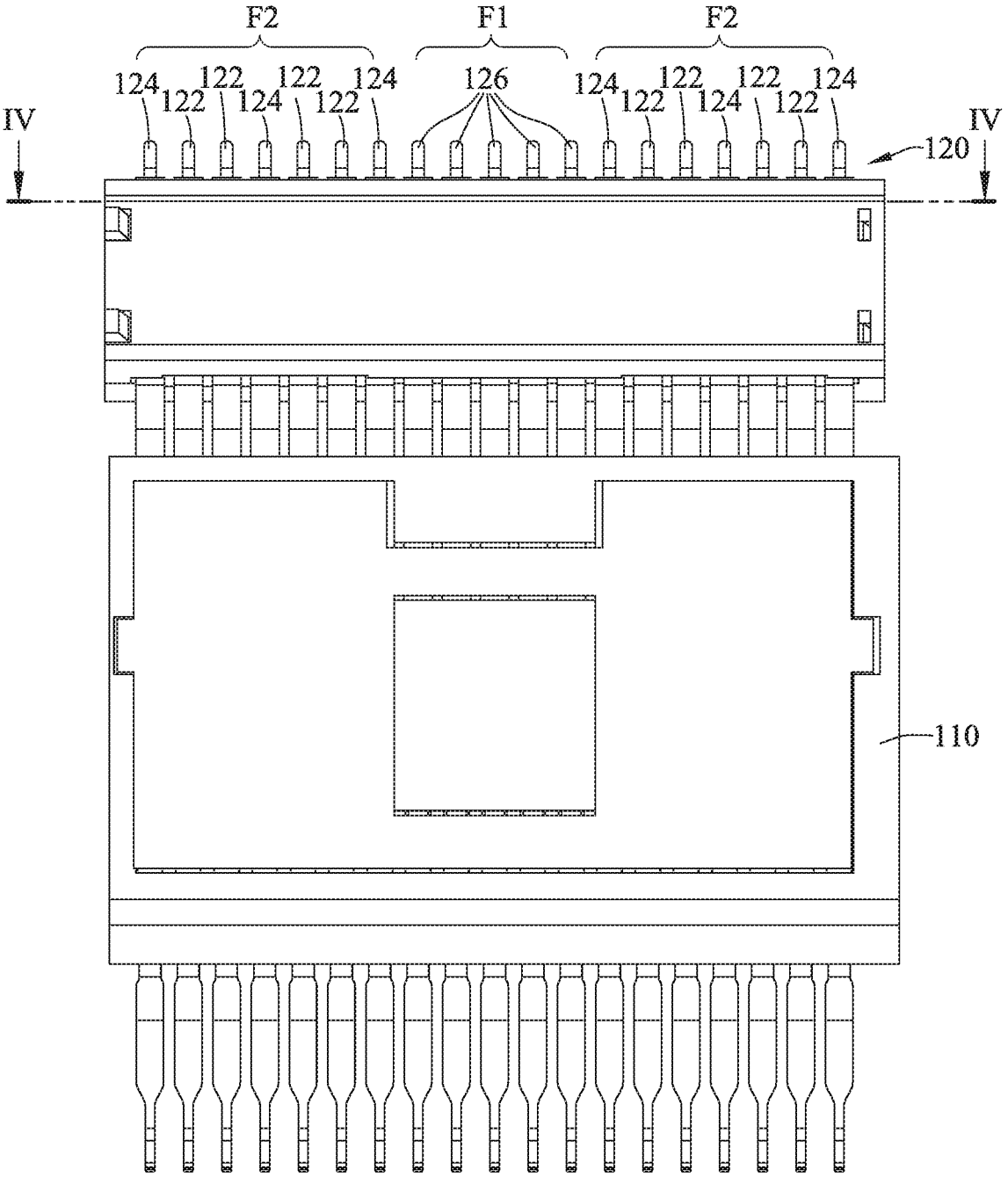
FIG. 3 is a schematic top view of FIG. 1.
Figure 4:
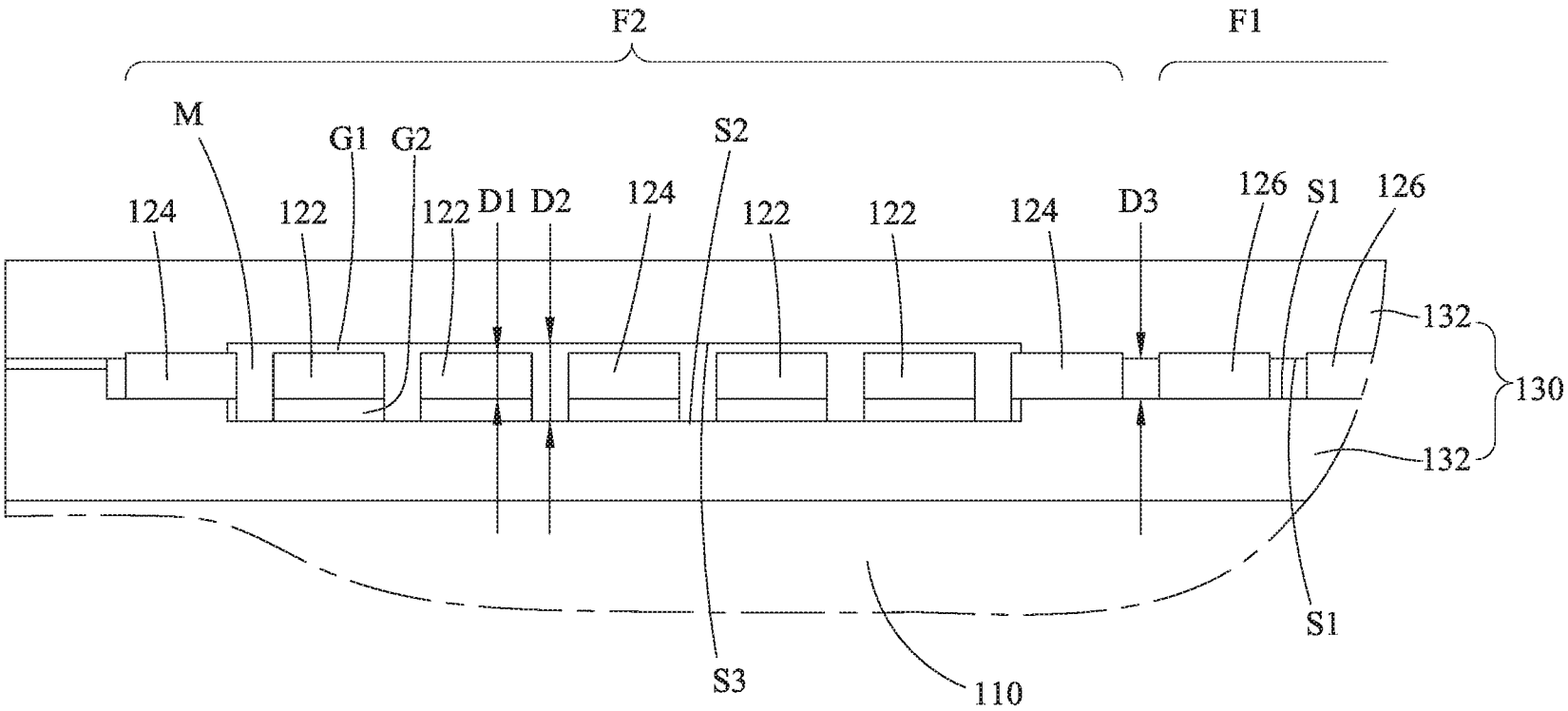
FIG. 4 is a schematic enlarged cross-sectional view of FIG. 3 along line IV-IV.
Figure 5:
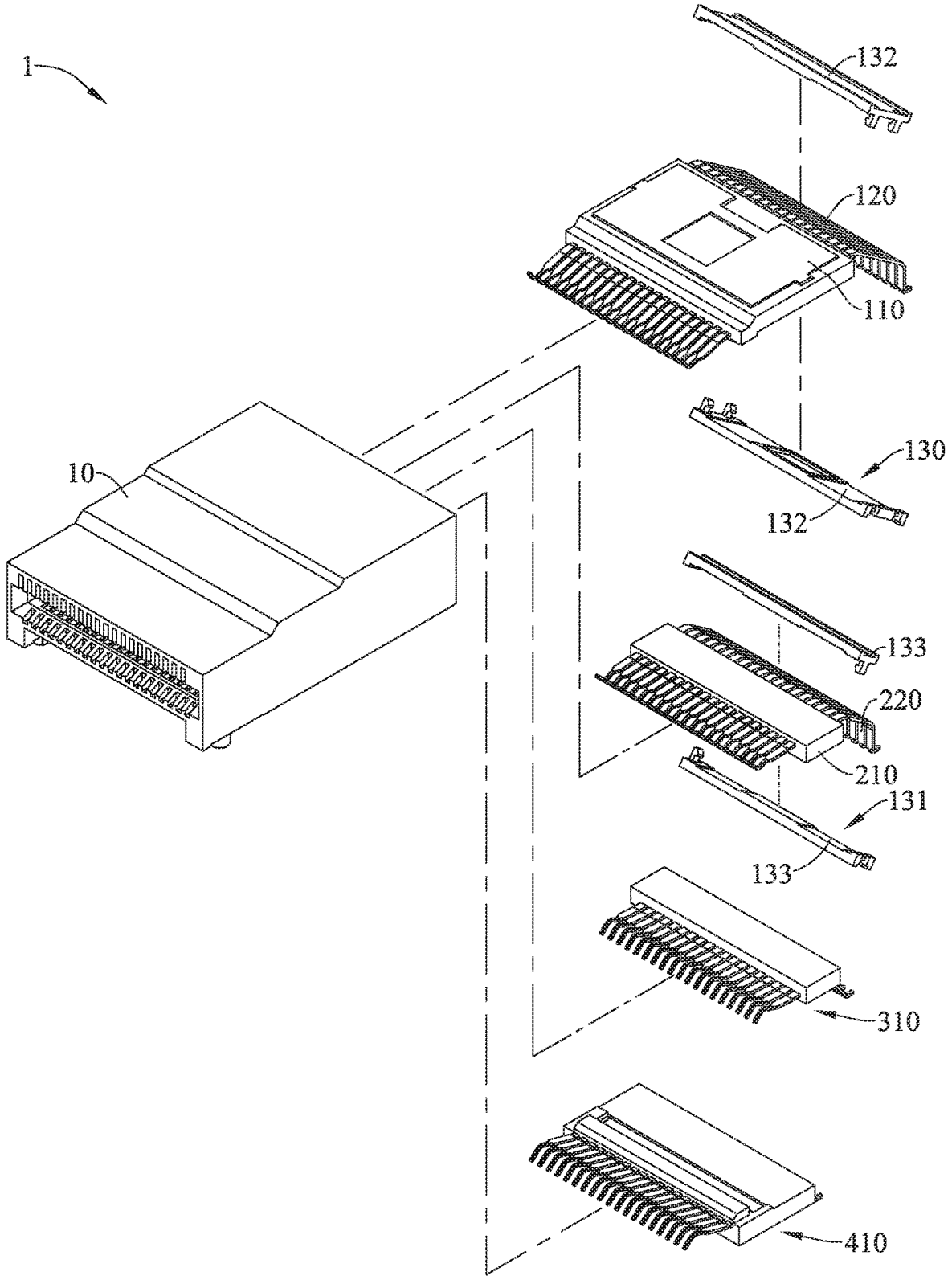
FIG. 5 is a schematic exploded view of another embodiment of the connector in accordance with this disclosure.

Refer to FIG. 1 to FIG. 4; where FIG. 1 is a schematic perspective view of an embodiment of the connector in accordance with this disclosure, FIG. 2 is another view of FIG. 1 with the spacer plate separated therefrom, FIG. 3 is a schematic top view of FIG. 1, and FIG. 4 is a schematic enlarged cross-sectional view of FIG. 3 along line IV-IV. As shown, the embodiment of the electronic connector or the connector 100 of this disclosure, applicable to products already in the marketplace, mainly includes an insulated shelter 10 (as shown in FIG. 5), at least one main body 110, a terminal group 120 and an insulated plastic element 130.

The terminal group 120 is integrated with the main body 110 by having two opposing sides thereof to extend out of the main body 110. The insulated plastic element 130, formed as an independent element, is used for enclosing up and fixing the terminal group 120. In this embodiment, the insulated plastic element 130 can be made of an insulation material for shielding or improving the crosstalk effects upon signals at terminals. In another embodiment, a plurality of insulated plastic elements 130 can be disposed to, but not limited to, each side of the terminal group 120.

In this embodiment, the terminal group 120 can include a plurality of terminals 122, 124, 126 for transmitting signals at different speeds, grounding, or receiving power. The terminal group 120 has two opposing sides defined as a contact portion 121 and a welding portion 123. The contact portion 121 is used for contacting contact points of the other electronic element to be engaged, and the welding portion 123 is used to be soldered onto a circuit board. As shown in FIG. 2, the insulated plastic element 130 can be consisted of two identical or symmetric spacer plates 132 buckled to each other, so that a slot M can be formed between every two opposing inner surfaces (i.e., first inner surfaces S1, second inner surfaces S2 and third inner surfaces S3). In this embodiment, the slot M is used for enclosing up the terminal group 120 and fixing the insulated plastic element 130 to the terminal group 120. The slot M can be at least divided into a section F1 and an adjacent section F2, in which a height D3 of the section F1 is less than another height D2 of the section F2. As shown in FIG. 3 and FIG. 4, the plurality of terminals 122, 124, 126 can be enclosed up into the respective section F1 and section F2 of the slot M. In this embodiment, the terminals 124 can be ground terminals, the terminals 122 can be high-speed signal terminals, and a plurality of the terminals 126 can be power terminals, ground terminals or low-speed signal terminals. The foregoing arrangement of terminals can be easily found in an ordinary connector terminal group in the market place, and thus is not used to limit the embodiment of this disclosure.

In this embodiment, each of the terminals 122, 124, 126 of the terminal group 120 has the same thickness D1 and width. As shown in FIG. 4, the slot M can be divided into at least one section according to practical requirements. For example, a vertical distance or the height D2 between the two opposing inner surfaces (i.e., the second inner surface S2 and the third inner surface S3) at the section F2 can be set to be a distance larger than the thickness D2 of the terminals 122, 124, 126. In the other section, for instance, another vertical distance or the height D3 at the section F1 can be set to be less than or equal to the thickness D1 of the terminals. If signal terminals, the terminals 122 for transmitting high-speed signals for example, is vulnerable to crosstalk effects, then the height D2 would be set to be greater than the thickness D1 of the terminals 122 according to this disclosure, such that the slot M between the two corresponding inner surfaces (i.e., the second inner surface S2 and the third inner surface S3)) can provide at least the terminals 122 to simultaneously have upper and lower gaps G1, G2 to space the adjacent inner surfaces S3, S2, respectively. Upon such an arrangement for providing the gaps G1, G2 to space the terminals 122 for transmitting high-speed signals from the respective neighboring inner surfaces of the insulated plastic element 130, the transmission quality of the connector 100 can be substantially enhanced by improving the crosstalk effects among the terminals, through adjusting dielectric coefficients and thus electromagnetic properties around the terminals by having a different medium (the air) with desired local thicknesses to exist inside the insulated plastic element 130.

Further, in this embodiment, since appearances and intervals of the terminals can be kept the same, the aforesaid arrangement can be applied to any connector with arbitrary specs. Namely, with the insulated plastic element 130 provided by this disclosure, crosstalk effects among terminals 122 occurring while in transmitting, but not limited to, high-speed signals can be substantially reduced.

As shown in FIG. 4, though the two gaps G1, G2 between the two inner surfaces (i.e., the second inner surface S2 and the third inner surface S3) are formed in the slot M at the section F2 having the signal terminals 122, yet no gap exist to the neighboring terminals 124 or the terminals 126 in the slot M at the section F1. That is, it shall be understood that the formation of the gaps G1, G2 of this embodiment is mainly used for varying the dielectric coefficients surrounding the signal terminals 122, but with the other terminals 124, 126 to be firmly disposed in the slot M so as to holding the terminal group 120 firmly by the insulated plastic element 130. Nevertheless, the aforesaid embodiment is typical, and not to limit the possibility of gaps between the terminals 124 or 126 and the insulated plastic element 130. In practice, the gap arrangement between the insulated plastic element 130 and the terminal group 120 is mainly up to design requirements.

In addition, it is noted that embodying of this disclosure is not related to any change in appearance, structure, quantity or manufacturing of the insulated plastic element 130. For example, referring to FIG. 2, the insulated plastic element 130 is formed by buckling two identical spacer plates 132 in a symmetrical manner. Each of the spacer plates 132 can have a first inner surface S1, a second inner surface S2 and a third inner surface S3, in which the first inner surface S1 is located between the second inner surface S2 and the third inner surface S3, and the first inner surface S1 has a thickness larger than that of the second inner surface S2 or the third inner surface S3. Referring to FIG. 3 or FIG. 4, after the two spacer plates 132 are buckled together, the distance (or the height D3) spacing the two opposing first inner surfaces S1 is less than or equal to the thickness D1 of any terminal 126 at the section F1, such that the two spacer plates 132 can firmly contact the terminals 126. As such, the insulated plastic element 130 can firmly hold the terminal group 120. In addition, since the distance (or the height D2) between the second inner surface S2 and the opposing third inner surface S3 is greater than the thickness D1 of the terminals 122, 124 at the section F2, so at least one gap G1 or G2 can exist between the terminals 122 and the neighboring spacer plate 132. However, the existence of another gap between the ground terminals 124 at the section F2 and the insulated plastic element 130 can be determined according to practical demands. In addition, though the embodiment in FIG. 2 includes two spacer plates 132, yet, in some other embodiments not shown herein, a one-piece spacer plate can be adopted by folding to buckle two opposing sides together so as for forming a slot M thereinside.

In one embodiment, a buckling part H1 or a buckled part H2 can be furnished to two opposing sides of the spacer plate 132 of FIG. 2. In an exemplary example, the buckling part H1 can be a locking protrusion, while the buckled part H2 is a locking slot for engaging the locking protrusion. With the buckling part H1 to buckle the buckled part H2, the two spacer plates 132 can be firmly combined to form the insulated plastic element 130. Nevertheless, in some other embodiment of this disclosure, an adhering means can be applied to assemble the two spacer plates 132, or an injection-molding means can be directly applied to form the insulated plastic element 130 onto the terminal group 120.

Referring to FIG. 5, a schematic exploded view of another embodiment of the connector in accordance with this disclosure is shown. In this embodiment, the connector 1 can further include an insulated shelter 10 for accommodating and thus protecting all the main bodies 110, 210, 310, 410, the terminal groups 120, 220 and the insulated plastic elements 130, 131. The insulated plastic element 131 is formed by buckling two spacer plates 133. The only difference between the spacer plate 133 and the other spacer plate 132 is at the quantity and positions of the buckling part and the buckled part.

Figure 6:
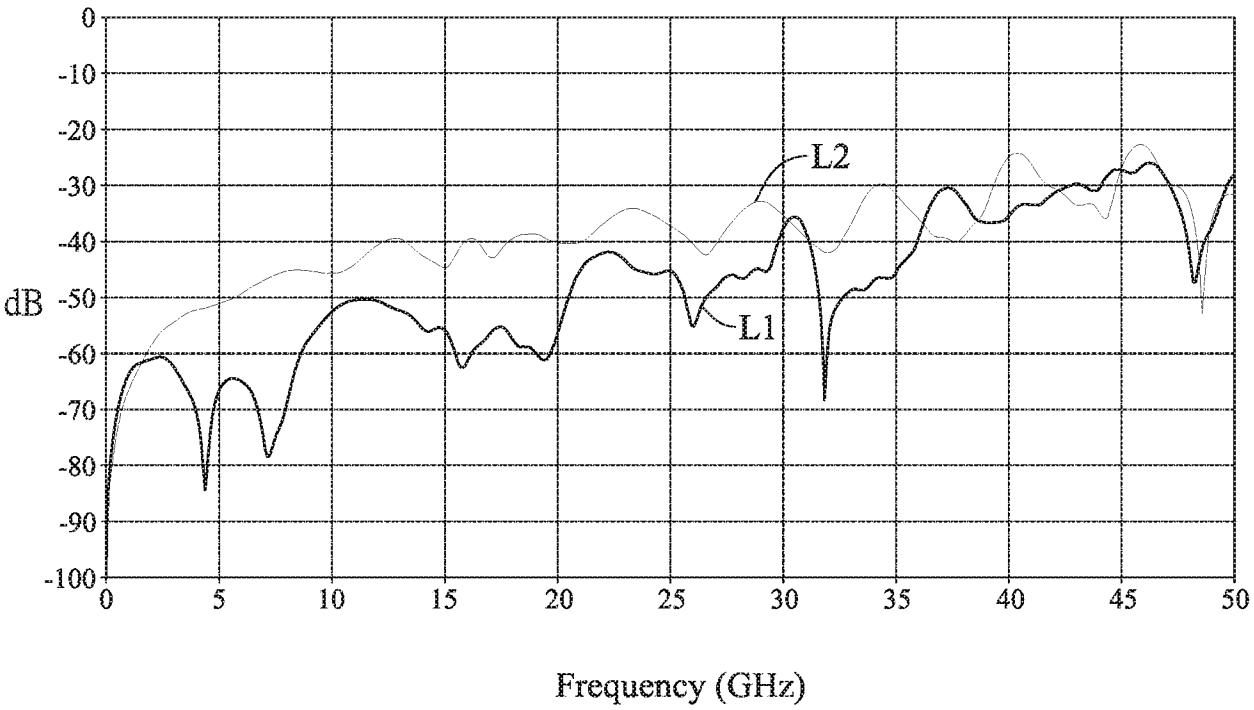
FIG. 6 is a comparison plot of simulated gains between the embodiment of this disclosure and the prior art.

In order to verify if the use of the insulated plastic element 130 in this disclosure can effectively improve the crosstalk effects upon the signal terminals of the connector, testing is arranged as follows. In the testing, Sample 1 is a connector 100 furnished with the insulated plastic element 130, and Sample 2 is the same-type connector without the insulated plastic element 130. After simulations to experience various signal transmissions, variations in gains are shown in FIG. 6. In FIG. 6, the unit scale for the horizontal coordinate is GHz, while that for the vertical coordinate is dB. Further, Curve L1 is for Sample 1, and Curve L2 is for Sample 2. As shown, for frequencies below 30 GHz, Sample 1 having the insulated plastic element 130 performs superior to Sample 2 without the insulated plastic element 130. Namely, in the frequency domain under 30 GHz, problems at the connector caused by the crosstalk effects can be significantly reduced.

In summary, by providing gaps (for example, but not limited to, 0.2 mm or lower) to space the terminals for transmitting high-speed signals from the insulated plastic element, the dielectric coefficients and the electromagnetic properties around the terminals can be adjusted to reduce the crosstalk effects upon the terminals, and thus the transmission performance of the connector can be substantially improved.

Further, the resort of this disclosure does not involve change in the terminal appearance and interval, thus the structuring of the connector can be kept the same. In other words, the insulated plastic element of this disclosure can be applied to versatile specs of the connectors for reducing the notorious inherent crosstalk effects.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A connector, comprising:

an insulated shelter, accommodating at least one main body, the main body including at least one terminal group, the terminal group being integrated with the main body by having two opposing sides thereof to extend out of the main body, the two opposing sides being defined as a contact portion and a welding portion, the terminal group further including a plurality of terminals; and at least one insulated plastic element, having thereinside a slot for enclosing up the terminal group, a height D2 of a first section in the slot being larger than a thickness D1 of the plurality of terminals to form at least one air gap in the slot in order to separate the terminal group apart from the insulated plastic element, wherein the plurality of terminals are entirely not in contact with two opposing inner surfaces of the first section in the slot.

2. The connector of claim 1, wherein the height D2 of the first section in the slot is a distance between the two opposing inner surfaces of the first section in the slot.

3. The connector of claim 1, further including a second section in the slot, wherein a height D3 of the second section is less than or equal to the thickness D1 of the plurality of terminals.

4. The connector of claim 1, wherein the insulated plastic element includes two spacer plates, each of the two spacer plates having a buckling part and a buckled part opposing the buckling part.

5. The connector of claim 4, wherein the buckling part is a locking protrusion, and the buckled part is a locking slot.

6. The connector of claim 1, wherein the insulated plastic element is a spacer plate, and the spacer plate having a buckling part and a buckled part opposing the buckling part.

7. The connector of claim 6, wherein the buckling part is a locking protrusion, and the buckled part is a locking slot.

8. An insulated plastic element, applied to a connector, the connector including an insulated shelter, the insulated shelter accommodating at least one main body, the main body including at least one terminal group, the terminal group being integrated with the main body by having two opposing sides thereof to extend out of the main body, the two opposing sides being defined as a contact portion and a welding portion, the terminal group further including a plurality of terminals;

wherein the insulated plastic element has thereinside a slot for enclosing up the terminal group, and a height D2 of a first section in the slot is larger than a thickness D1 of the plurality of terminals to form at least one air gap in the slot in order to separate the terminal group apart from the insulated plastic element, wherein the plurality of terminals are entirely not in contact with two opposing inner surfaces of the first section in the slot.

9. The insulated plastic element of claim 8, wherein the height D2 of the first section is a distance between the two opposing inner surfaces of the first section in the slot.

10. The insulated plastic element of claim 8, further including a second section in the slot, wherein a height D3 of the second section is less than or equal to the thickness D1 of the plurality of terminals.

11. The insulated plastic element of claim 8, wherein the insulated plastic element includes two spacer plates, each of the two spacer plates having a buckling part and a buckled part opposing the buckling part.

12. The insulated plastic element of claim 11, wherein the buckling part is a locking protrusion, and the buckled part is a locking slot.

13. The insulated plastic element of claim 8, wherein the insulated plastic element is a spacer plate, and the spacer plate having a buckling part and a buckled part opposing the buckling part.

14. The insulated plastic element of claim 13, wherein the buckling part is a locking protrusion, and the buckled part is a locking slot.

* * * * *